United States Patent [19]

Christy, Sr.

[11] 4,333,574

[45] Jun. 8, 1982

[54] WOOD RACK

[76] Inventor: R. Steven Christy, Sr., 389 Poplar Lent Rd., Concord, N.C. 28025

[21] Appl. No.: 118,745

[22] Filed: Feb. 5, 1980

[51] Int. Cl.[3] ..... A47G 29/00

[52] U.S. Cl. ..... 211/60 R; 52/93; 211/49 R

[58] Field of Search ..... 272/1 A; 46/12, 17, 46/19; 52/90, 648, 92, 93; 211/60 R; D7/212

[56] References Cited

U.S. PATENT DOCUMENTS 1,352,011 11/1886 Shelton ..... 52/92

FOREIGN PATENT DOCUMENTS 46312 6/1888 Fed. Rep. of Germany ..... 46/19

*Primary Examiner*—John E. Murtagh

*Attorney, Agent, or Firm*—Shlesinger, Arkwright, Garvey & Dinsmore

[57] ABSTRACT

A firewood rack or the like which includes two upright closed frames, a closed base frame, and a hipped roof which mounts on the upright frames.

5 Claims, 9 Drawing Figures

WOOD RACK

BACKGROUND OF THE INVENTION

This invention pertains to a rack for protecting stacked pieces of wood. In particular, this rack is for outside storage of firewood. In the past, firewood was generally stacked on supports which suspended the wood pieces a few inches off the ground. However, the wood was subject to rotting as rain, snow and the like would fall unimpeded on top of the logs. As such, the logs would become soaked and difficult to use as firewood or, in time, become so badly deteriorated as to be useless. In addition, in a residential area, the stacks of wood would present an eyesore in the yard of the owner.

Many of the previous wood supporting structures were poorly constructed to withstand the weight of a stack of wood. Previous racks would, in many cases, rock, wiggle or fall apart. If a rack collapsed, the stacked logs would quickly start to roll which would present a hazard for the person retrieving the logs.

SUMMARY AND OBJECTS OF THE INVENTION

In view of the foregoing an object of this invention is to provide a rack which supports stacked wood off the ground.

An object of the present invention is to provide a stable well constructed wood rack providing side support for the stacked wood.

A further object of this invention is to provide a rack which provides protection for stacked wood from rain, snow, and the like.

Still another object of this invention is to provide a rack for stacking wood which is attractive in appearance so as not to be an eyesore in the yard of the owner.

Yet another object of this invention is to provide a rack for stacking wood which is easily and quickly constructed at the location of use.

Yet a further object of this invention is to provide a rack for stacking wood in which the various support members are interlocked so as to provide a stable, rock free, support for the wood.

An additional object of this invention is to provide a rack for stacking wood where the wood can be easily stacked or removed.

These and other objects of this invention will become apparent in view of the following specification and claims.

DESCRIPTION OF THE DRAWINGS

FIGS. 1-5

Figure 4:
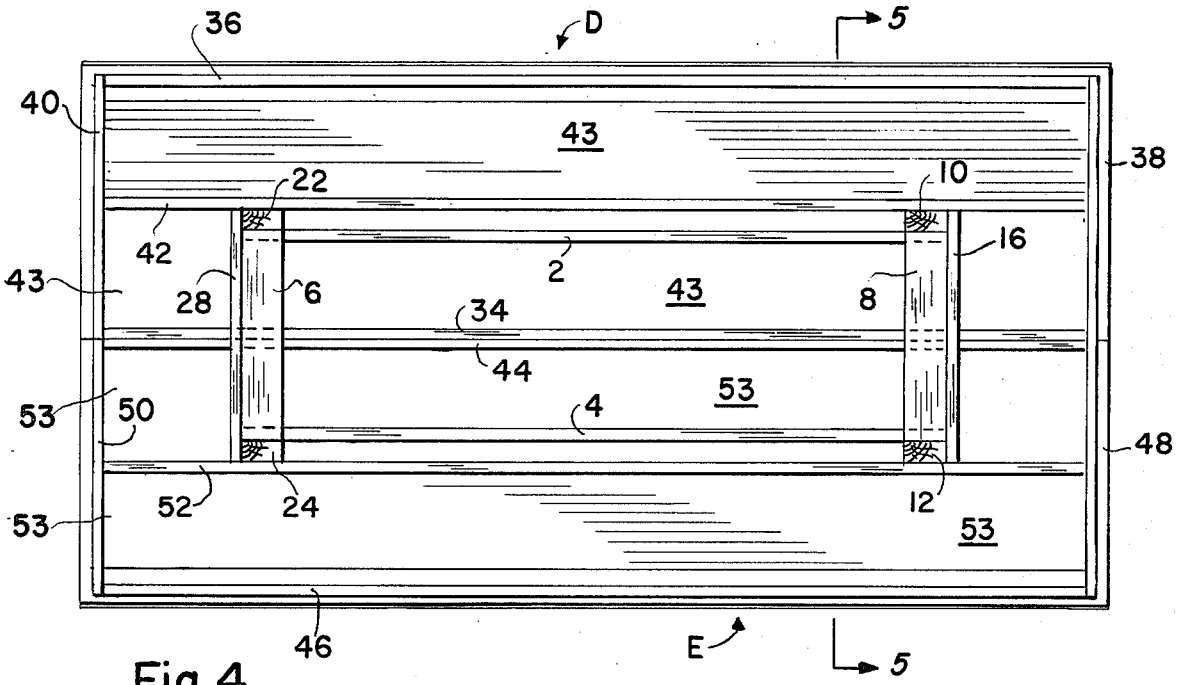
FIG. 4 is a bottom plan view showing the underside of the roof of the wood rack.

Base frame A consists of two side supports 2 and 4, and two end braces 6 and 8, (end brace 8 shown in FIG. 4).

Upright frame B consists of two side supports 10 and 12, a top brace 14, a bottom brace 16, and two side braces 18 and 20.

Figure 3:
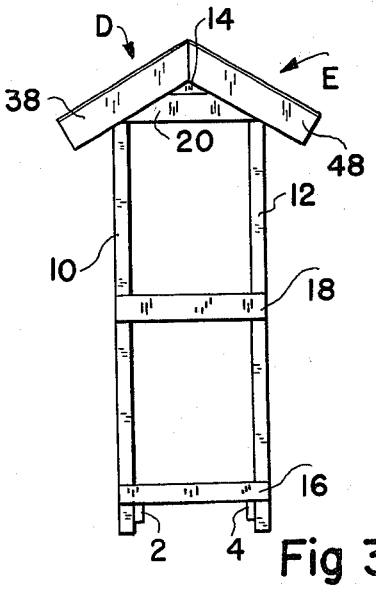
FIG. 3 is a side elevational view of the wood rack.
Figure 7:
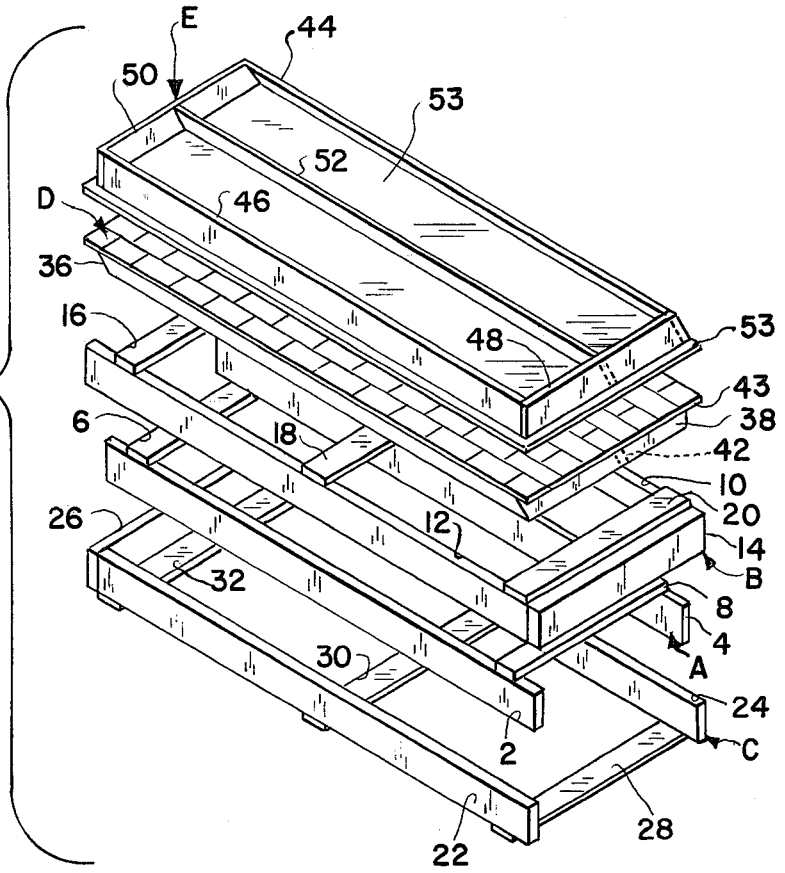
FIG. 7 is an exploded view showing the parts of the invention positioned for stacking.

Upright frame C is identical to frame B and consists of two side supports 22 and 24, a top brace 26 (FIG. 3), a bottom brace 28, and two side braces 30 and 32. (FIG. 7)

Roof section D consists of a top support brace member 34 (FIG. 5), a bottom member 36, two side members 38 and 40, an adjacent horizontal support brace 42 (FIG. 5), and a roof covering 43.

Roof section E is identical to roof section D and consists of a top brace member 44 (FIG. 5), a bottom member 46, two side members 48 and 50 , an adjacent horizontal support brace 52, and a roof covering 53.

FIG. 6

The connection between upright frame B side support 12 and base frame A side support 4 is shown.

FIGS. 7-9

Figure 8:
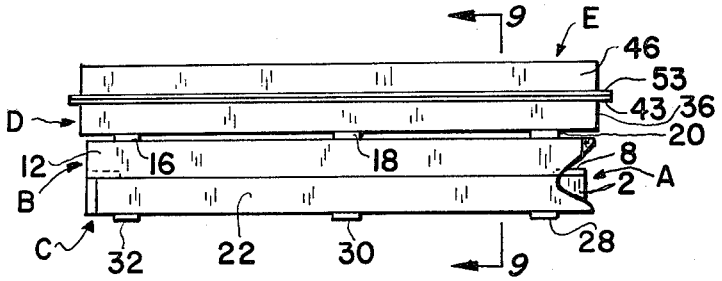
FIG. 8 is a side elevational view showing the wood rack in a compact stacked arrangement for shipping or storage.
Figure 9:
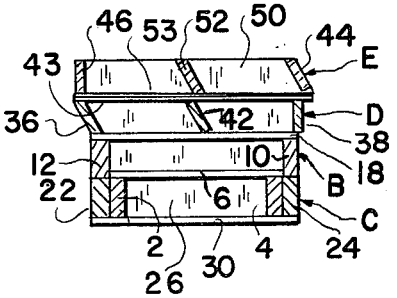
FIG. 9 is a cross sectional view taken along the lines 9—9 of FIG. 8 and viewed in the direction of the arrows.

FIGS. 7 through 9 show the five elements, the base frame A, the two upright frames B and C, and the two roof sections D and E in the stacked or storage position.

ASSEMBLY

Figure 1:
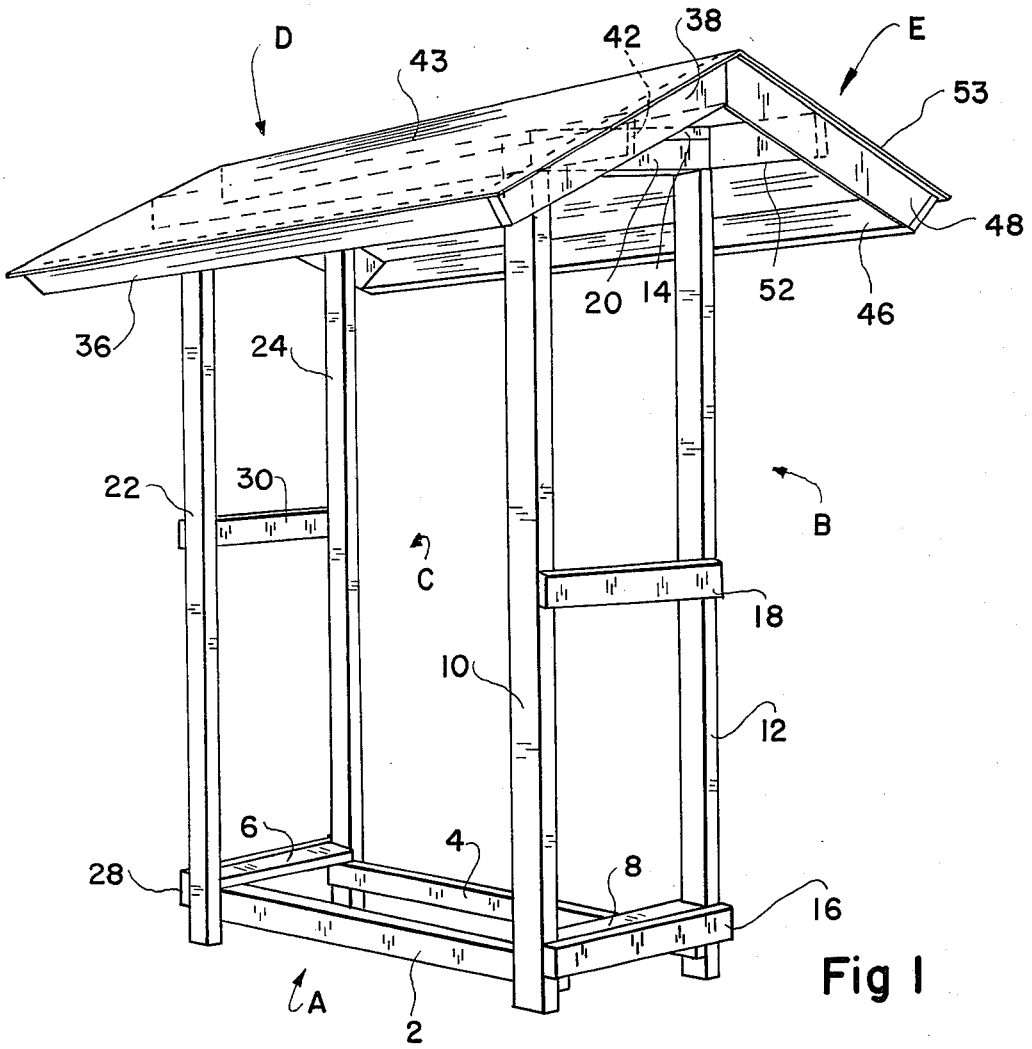
FIG. 1 is a perspective view of the wood rack.

The firewood rack may be made from wood, plastic, metal or the like, though the preferred embodiment as shown in the drawings is wood. In FIG. 1, the base frame A fits in between the side supports 10 and 12 of frame B and in between the side supports 22 and 24 of frame C.

Figure 6:
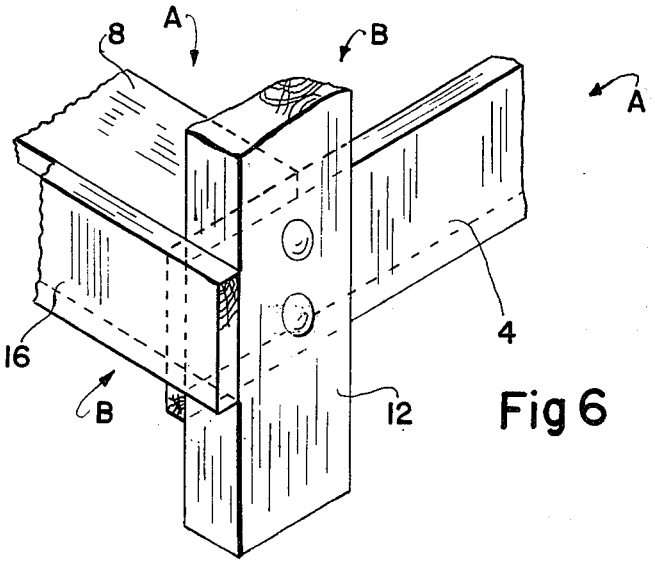
FIG. 6 is an enlarged fragmentary perspective view showing, in detail, the joining of one corner of the base frame and one corner of a side support of one vertical closed frame member.

FIG. 6 shows the interconnection of the base frame A, side support 4 and the upright frame B, side support 12. The end surface of side support 4 and the outer edge of end brace 8 of frame A abut the inner surface of the bottom brace 16 of upright frame B. Additionally, the outer vertical surface of frame A, side support 4 and the inner vertical surface of upright frame B, side support 12 abut and are bolted as shown. This construction prohibits the frames A, B or C from wiggling with respect to each other. Although only one connection point is shown, the other three connection points between frames A, B and C are identical.

Figure 5:
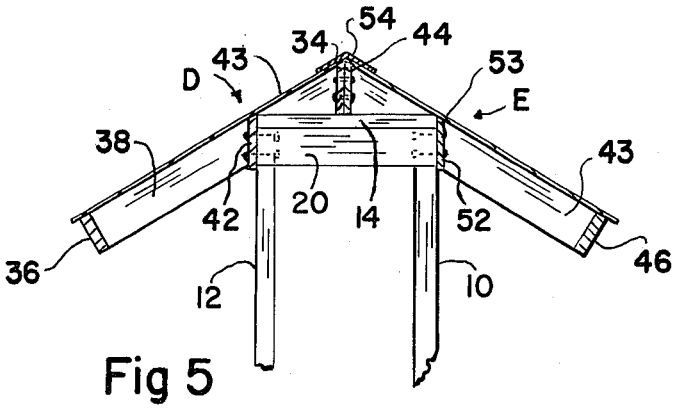
FIG. 5 is a fragmentary cross sectional view of the wood rack taken along the line 5—5 of FIG. 4 and viewed in the direction of the arrows.

As best shown in FIG. 7, the roof sections D and E are constructed as closed frames with an approximately adjacent horizontal support brace 42 for section D and 52 for section E. The top members 36 for section D and 44 for section E are fixed at an inclined angle. The adjacent horizontal braces 42 and 52 are also fixed at the same inclined angle. When the two roof sections are fastened together and mounted on the upright frames B and C as is shown in FIG. 5, the top support brace members 34 and 44, and the adjacent horizontal support braces 42 and 52 of the roof sections D and E are perpendicular with respect to the base frame A. When mounted, the top support members 34 and 44 of the roof sections D and E rest on the top braces 14 and 26 of upright frames B and C respectively. Also shown in FIG. 5 is the fastening connection between the roof sections D and E and the upright frames, frame B shown. The inner vertical surfaces of the horizontal braces 42 and 52 abut and are fastened to the outer vertical surfaces of upright frame side supports 10 and 12, and the end surfaces of top brace 14. Although only the connection between the roof sections D and E, and the upright frame B are shown, the connections between the roof sections D and E and upright frame C is identical.

Figure 2:
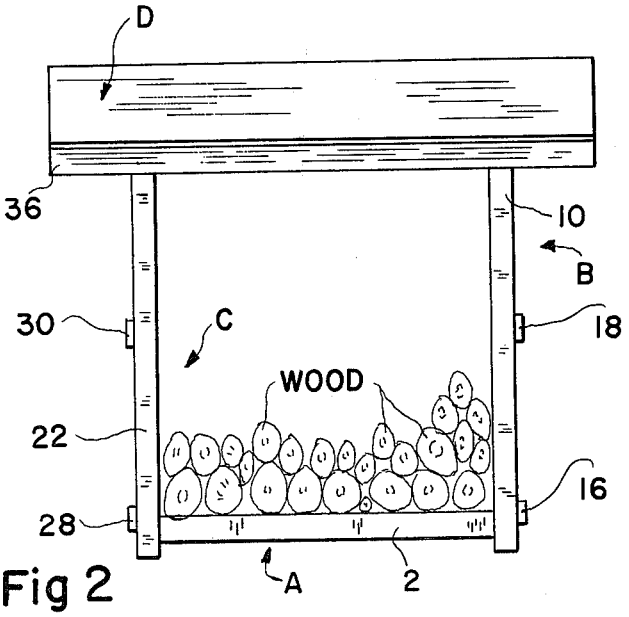
FIG. 2 is a front elevational view of the wood rack showing wood logs stacked in the rack.

As is shown in FIG. 2, the wood is stacked on top of the side supports 2 and 4 of the base frame A and between the upright frames B and C. The width of the wood rack can be changed by changing the length of 6 and 8 on frame A, 14, 16, 18 and 20 on frame B, 26, 28, 30 and 32 on frame C, and either changing the length of the side members 38, 40, 48 and 50 of the roof sections D and E or by changing the spacing of the horizontal braces 42 and 52 with respect to the top members 34 and 44 of the roof sections D and E. In like manner the length of the wood rack can be changed by changing the length of side supports 2 and 4 of frame A, and the roof members 34, 36 and 42 of section D and members 44, 46 and 52 of section E.

The roof covering 43 and 53 in FIG. 1 is made from wood shingles. However, many other materials such as plastic or metal could be used to perform the same function.

The members 36 and 46 as shown in the preferred embodiment, when positioned, are at an inclined angle to the ground. This provides additional life to the roof units affording protection against weathering of members 36 and 46.

In order to lessen the rotting of the roof by moisture, a flashing strip 54 is provided for covering the abutting edge of the roof sections D and E.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A knock-down rack for firewood or the like including:

(a) a pair of rectangular spaced upright closed frames each having top, bottom, left and right side braces, (b) said braces having vertical surfaces, (c) a horizontal closed rectangular base frame having a pair of end braces and a pair of side braces, (d) said horizontal closed rectangular frame receivable within one of said upright frames, (e) one of said pair of upright frames having means for connecting it to one end of said horizontal closed rectangular frame adjacent said upright frame's bottom brace and the other of said pair of upright frames having means for connecting it to the other end of said horizontal frame adjacent said other upright frame's bottom brace, (f) a hipped roof for said rack having a top side and an underside including a pair of interconnected separable closed frames connected to said upright frames, (g) said interconnected separable frames each including a pair of spaced vertical horizontal braces parallel to each other, (h) each pair of spaced horizontal braces including a top support brace and an adjacent support brace, (i) said top support braces mounted adjacent each other and directly engaging the top braces of said spaced upright closed frames, (j) said adjacent support brace of one of said pair of separable frames mounted adjacent said left side braces of said upright frames and said adjacent support brace of the other of said pair of separable frames mounted adjacent said right side braces of said upright frames, (k) said closed frames each being substantially similar in length and width and being substantially longer than wider and stackable one on the other for shipping prior to assembly, and (l) said rack including ground engaging support means, and being open-sided to provide an unobstructed wood receiving opening therein.

2. A firewood rack as in claim 1 and wherein:

(a) said adjacent support braces of said hipped roof are connected to said upright frames adjacent said top braces of said upright frames.

3. A firewood rack as in claim 2 and wherein:

(a) said upright closed frames include said ground engaging support means.

4. A firewood rack as in claim 3 and wherein:

(a) said base frame is mounted inside and between said upright frames left and right side braces.

5. A firewood rack as in claim 4 and including:

(a) a covering surface for said roof, and (b) said top support and adjacent support braces of said interconnected separable frames for said hipped roof are at an inclined angle to said covering surface.

* * * * *